US011428034B2

(12) United States Patent
Rupp et al.

(10) Patent No.: US 11,428,034 B2
(45) Date of Patent: Aug. 30, 2022

(54) ARRANGEMENT FOR GUIDING A SLIDING DOOR OR FOLDING-SLIDING DOOR ON A FURNITURE WALL

(71) Applicant: Julius Blum GmbH, Hoechst (AT)

(72) Inventors: Matthias Rupp, Hohenweiler (AT); Christian Hauer, Hoerbranz (AT); Hermann Haemmerle, Lustenau (AT); Ingo Gasser, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 550 days.

(21) Appl. No.: 16/505,855

(22) Filed: Jul. 9, 2019

(65) Prior Publication Data

US 2019/0330898 A1 Oct. 31, 2019

Related U.S. Application Data

(63) Continuation of application No. PCT/AT2017/060309, filed on Nov. 21, 2017.

(30) Foreign Application Priority Data

Jan. 13, 2017 (AT) ..... A 50019/2017

(51) Int. Cl.
*E05D 15/58* (2006.01)
*E05D 15/06* (2006.01)
(Continued)

(52) U.S. Cl.
CPC ..... *E05D 15/58* (2013.01); *E05D 15/0604* (2013.01); *E05D 15/264* (2013.01);
(Continued)

(58) Field of Classification Search
CPC ... E05D 15/58; E05D 15/0604; E05D 15/264; E05D 15/063; E05D 15/0665;
(Continued)

(56) References Cited

U.S. PATENT DOCUMENTS 3,722,964 A * 3/1973 Chitester ..... A47B 88/493 384/18
3,834,081 A * 9/1974 Catlett ..... E05F 15/603 49/360
(Continued)

FOREIGN PATENT DOCUMENTS

CN 101146977 3/2008
CN 103547758 1/2014
(Continued)

OTHER PUBLICATIONS

International Search Report dated Mar. 21, 2018 in International (PCT) Application No. PCT/AT2017/060309.
(Continued)

*Primary Examiner* — William L Miller
(74) *Attorney, Agent, or Firm* — Wenderoth, Lind & Ponack, L.L.P.

(57) ABSTRACT

An arrangement includes a first guide system to be fixed to a furniture wall and a second guide system to be fixed to the furniture wall a vertical distance from the first guide system. Each of the two guide systems has a guide and a guide body displaceably arranged on the guide, a carrier to which the sliding door or folding-sliding door can be fixed, and a cable pulling device for compensating for a tilting moment of the carrier. The cable pulling device includes a first pulling cable arranged between the guide body of the first guide system and an end of the guide of the first guide system and without connection to the second guide system. A second pulling cable is between the guide body of the second guide system and an end of the guide of the second guide system and without connection to the first guide system.

18 Claims, 18 Drawing Sheets

(51) Int. Cl.
*E05D 15/26* (2006.01)
*E06B 3/50* (2006.01)

(52) U.S. Cl.
CPC ..... *E06B 3/5045* (2013.01); *E05Y 2900/212* (2013.01); *Y10T 16/364* (2015.01)

(58) Field of Classification Search
CPC ..... E06B 3/5045; E05Y 2900/212; E05Y 2201/654; E05Y 2201/62; E05Y 2201/222; Y10T 16/364; Y10T 16/381; Y10T 16/3825; Y10T 16/3837; Y10T 16/384
USPC ..... 16/91, 97, 102, 106, 107
See application file for complete search history.

(56) References Cited

U.S. PATENT DOCUMENTS

| | | | | |
|---|---|---|---|---|
| 7,845,116 | B2 | 12/2010 | Masuda | |
| 8,011,413 | B2 | 9/2011 | Poppema | |
| 8,276,316 | B2 | 10/2012 | Takeda et al. | |
| 8,984,810 | B2 | 3/2015 | Bortoluzzi et al. | |
| 9,068,386 | B2 | 6/2015 | Ishii et al. | |
| 9,187,043 | B2 | 11/2015 | Doll et al. | |
| 9,242,533 | B2 | 1/2016 | Snider et al. | |
| 10,822,863 | B2 * | 11/2020 | Bernhagen | E06B 3/4609 |
| 10,947,763 | B2 * | 3/2021 | Blum | E05D 15/58 |
| 11,008,791 | B2 * | 5/2021 | Rupp | E05F 1/08 |
| 11,136,804 | B2 * | 10/2021 | Rupp | E05F 5/003 |
| 2004/0100170 | A1 * | 5/2004 | Brown | E05D 15/58 312/322 |
| 2006/0283564 | A1 | 12/2006 | Poppema | |
| 2009/0019776 | A1 * | 1/2009 | Ohtaki | E05D 13/00 49/360 |
| 2009/0049752 | A1 | 2/2009 | Masuda | |
| 2012/0247239 | A1 * | 10/2012 | Hortig | B65G 1/0407 74/89.22 |
| 2013/0257247 | A1 | 10/2013 | Doll et al. | |
| 2014/0182212 | A1 | 7/2014 | Bortoluzzi et al. | |
| 2015/0008811 | A1 | 1/2015 | Ishii et al. | |
| 2019/0284859 | A1 * | 9/2019 | Rupp | E05D 15/58 |
| 2019/0301218 | A1 * | 10/2019 | Rupp | E05D 15/58 |
| 2019/0330897 | A1 * | 10/2019 | Rupp | E06B 3/482 |
| 2019/0330898 | A1 * | 10/2019 | Rupp | E05D 15/0665 |
| 2020/0018107 | A1 * | 1/2020 | Rupp | E05D 15/58 |
| 2020/0018108 | A1 * | 1/2020 | Sperger | E05D 15/58 |
| 2021/0246699 | A1 * | 8/2021 | Goetz | E06B 3/5045 |

FOREIGN PATENT DOCUMENTS

| | | | | |
|---|---|---|---|---|
| CN | 104080992 | | 10/2014 | |
| DE | 19632427 | A1 * | 2/1998 | E05F 15/646 |
| DE | 197 09 461 | | 9/1998 | |
| DE | 10 2009 016 637 | | 10/2010 | |
| DE | 10 2012 006 832 | | 10/2013 | |
| DE | 20 2013 010 658 | | 3/2014 | |
| EP | 1 394 349 | | 3/2004 | |
| EP | 2 169 167 | | 3/2010 | |
| JP | 60-141377 | | 9/1985 | |
| JP | 60-141378 | | 9/1985 | |
| JP | 2-266080 | | 10/1990 | |
| JP | 6-37480 | | 5/1994 | |
| JP | 2001-132332 | | 5/2001 | |
| TW | 201623769 | | 7/2016 | |
| WO | 2013/001274 | | 1/2013 | |
| WO | 2013/114730 | | 8/2013 | |
| WO | 2014/148747 | | 9/2014 | |

OTHER PUBLICATIONS

English translation of Search Report dated Nov. 4, 2018 in Taiwanese Application No. 107100144.
Search Report dated Oct. 2, 2017 in Austrian Application No. A 50019/2017, with English translation.

* cited by examiner

ARRANGEMENT FOR GUIDING A SLIDING DOOR OR FOLDING-SLIDING DOOR ON A FURNITURE WALL

BACKGROUND OF THE INVENTION

The invention relates to an arrangement for guiding a sliding door or folding-sliding door on a furniture wall, comprising:

- a first guide system to be fixed to the furniture wall and a second guide system to be fixed to the furniture wall with a vertical distance from the first guide system, wherein each of the two guide systems has a guide and a guide body displaceably arranged on the guide,
- a carrier to which the sliding door or folding-sliding door can be fixed, the carrier being connected in a movement-coupled manner to the two guide bodies of the guide systems, and
- a cable pulling device for compensating for a tilting moment of the carrier or of the sliding door or folding sliding door arranged thereon, respectively, about a tilting axis by a return moment.

The invention further concerns a method for mounting such an arrangement to a furniture wall.

Arrangements according to the features noted above are known, for example, from DE 10 2009 016 637 A1 or EP 1 394 349 A1. Basically, the challenge when guiding a sliding door or a folding-sliding door on a furniture wall lies in the fact that the sliding door or folding-sliding door has the tendency to tilt due to its weight. As a result, this leads to a wedging of the door between the vertically spaced guides of the guide systems, and, as a consequence, a displacement of the door is made impossible or is at least substantially restrained.

To prevent this, it is already known to provide a cable pulling device which serves for compensating for the tilting moment, namely such that the cable pulling device provides a respective return moment. In this way, a reliable and stable displacement of the sliding door or a folding-sliding door is made possible.

However, a drawback with these solutions according to the prior art is the fact that the cable pulling device has a very complex configuration and extends over a substantial part of the furniture wall. For example, a large number of deflection rollers are required which need to be fixed on exact predetermined positions. Moreover, the guides of the guide systems need to have a distance to be exactly adjusted from one other, so that the cable pulling device can produce its effect. With some solutions, a frame needs to be provided on which the cable pulling device is mounted, and that frame extends almost over the entire furniture wall. This leads, on the one hand, to very bulky package sizes for the guide systems to be fixed to the furniture wall or for the cable pulling device connected therewith, respectively, and to a large installation effort in which the slightest alignment errors must be precluded. Moreover, the cable pulling device has always to be adapted to the specific dimensions of the furniture wall, which is also disadvantageous.

It is an object of the present invention to avoid the described drawbacks according to the prior art and to propose an improved arrangement for guiding a sliding door or a folding-sliding door on a furniture wall. The arrangement can be, in particular, easily assembled and adjusted, has a small package size and is universally applicable. A further object is to propose an advantageous method for mounting such an improved arrangement on a furniture wall.

SUMMARY OF THE INVENTION

With the arrangement of the present invention for guiding a sliding door or a folding-sliding door on a furniture wall, the cable pulling device includes at least two pulling cables which are separated from each other. A first of the two pulling cables is arranged between the guide body of the first guide system and at least one end of the guide of the first guide system and is configured without connection to the second guide system, and a second of these two pulling cables is arranged between the guide body of the second guide system and at least one end of the guide of the second guide system and is configured without connection to the first guide system.

As a result of the fact that the cable pulling device includes at least two pulling cables configured to be separate from one another and each of which are associated to one of the two guide systems and do not have a connection to the respective other of the guide systems, the two guide systems can be mounted independently from one another. Moreover, the guides of the guide systems can be adjusted independently from one another, and that adjustment does not require a readjustment of the respective other of the guide systems. And finally, the space requirement for the guide systems is significantly reduced due to the inventive configuration of the pulling cables of the cable pulling device, whereby the guide systems can be packaged in smaller packaging sizes.

As noted before, a method for mounting an arrangement according to the invention to a furniture wall includes fixing the first guide system or the second guide system to the furniture wall. In a second method step, the other guide system is fixed to the furniture wall with a vertical spacing from the guide system fixed on the furniture wall during the first method step. In a third method step, the carrier is motionally coupled to the two guide bodies of the guide systems.

According to a preferred embodiment of this method, it is moreover provided that each of the guide bodies includes at least one engagement element for at least one pulling cable, and the engagement element of the guide bodies are coupled to one another by at least one synchronization device in a further method step between the second method step and the third method step.

BRIEF DESCRIPTION OF THE DRAWINGS

Further details and advantages of the present invention will be explained in the following with the aid of the description of figures and with reference to the drawings, in which.

DETAILED DESCRIPTION OF THE INVENTION

Figure 1A:
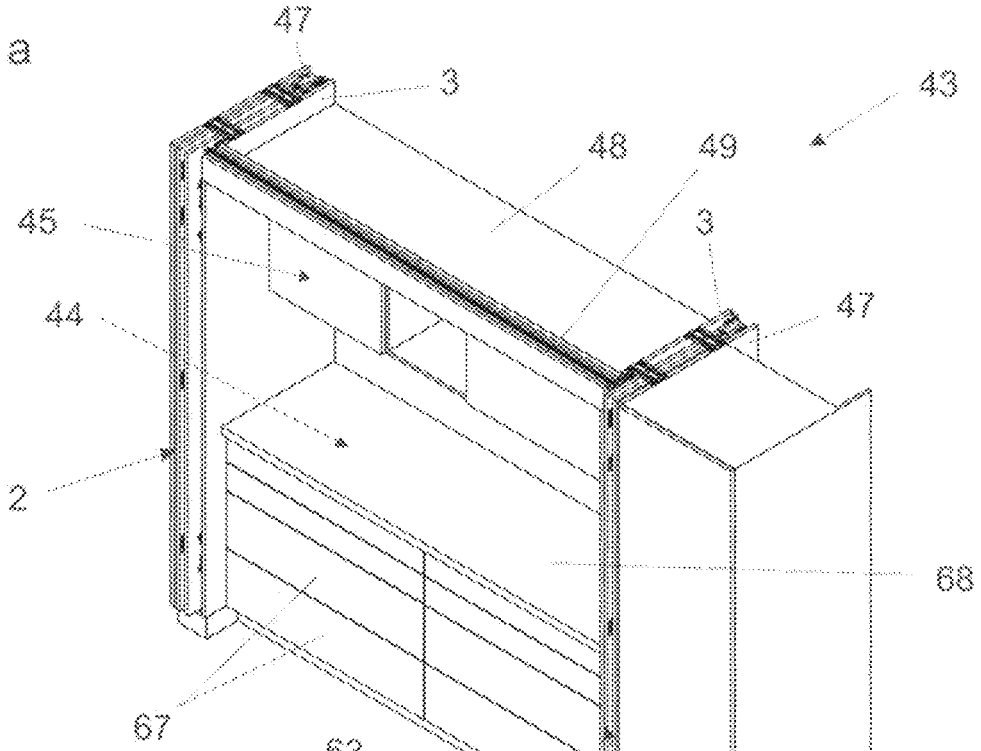
FIGS. 1*a*-1*d* show a kitchen configured to be partially covered by two folding-sliding doors, and the partial figures show different positions of the folding-sliding doors.

In FIG. 1*a*, a perspective view of a kitchen 43 is schematically depicted. The kitchen 43 may include different components, for example a base cabinet 44 with drawers 67 and a working surface 68, upper cabinets 45 and supply cupboards 46.

Arranged laterally besides the base cabinets 44 and the upper cabinets 45, compartments 63 are provided, each of the compartments 63 being formed by furniture walls 3 and 47 which are spaced from one another. In each of these compartments 63, a folding-sliding door 2 can be countersunk in a folded-together condition, as shown in FIG. 1*a*. The compartments 63 are connected to one another by a cover 48 and a rail system 49.

Figure 1B:
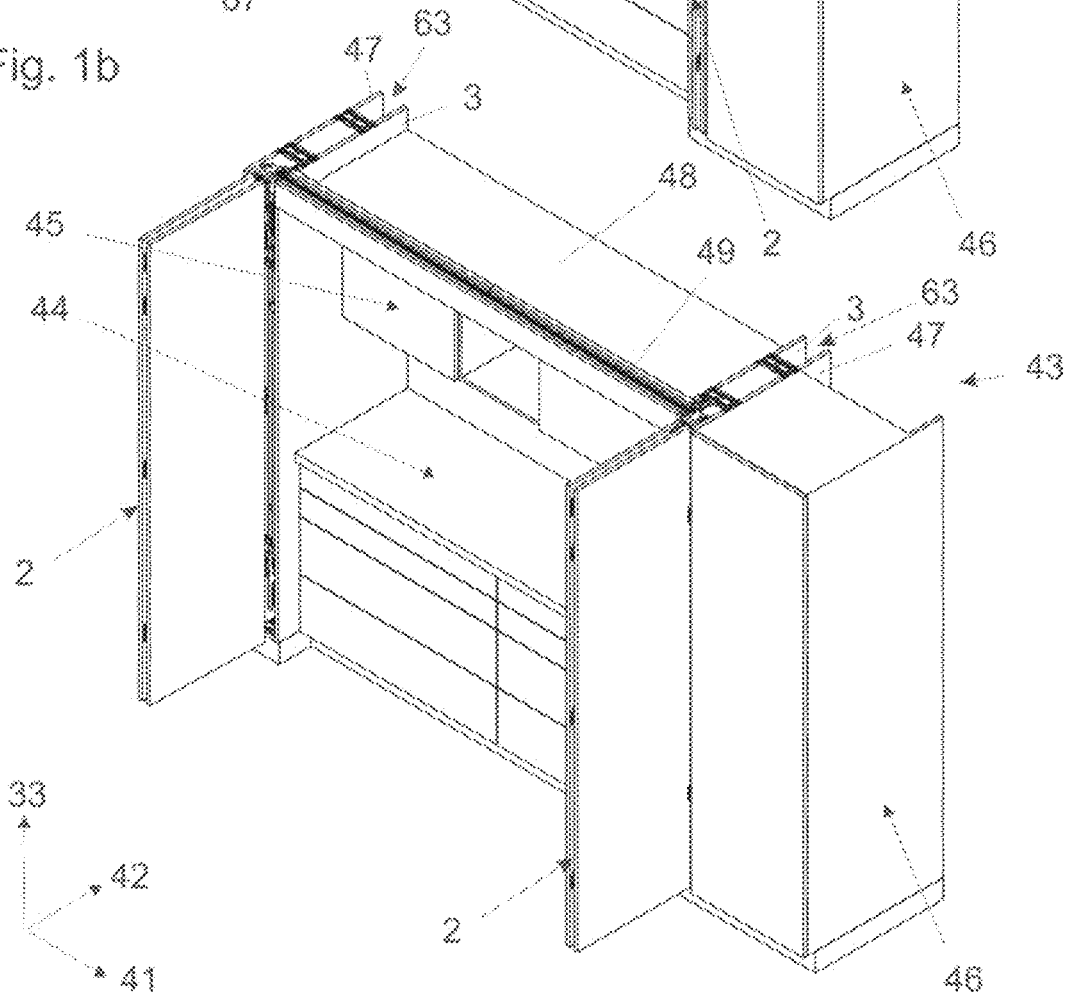
Figure 1C:
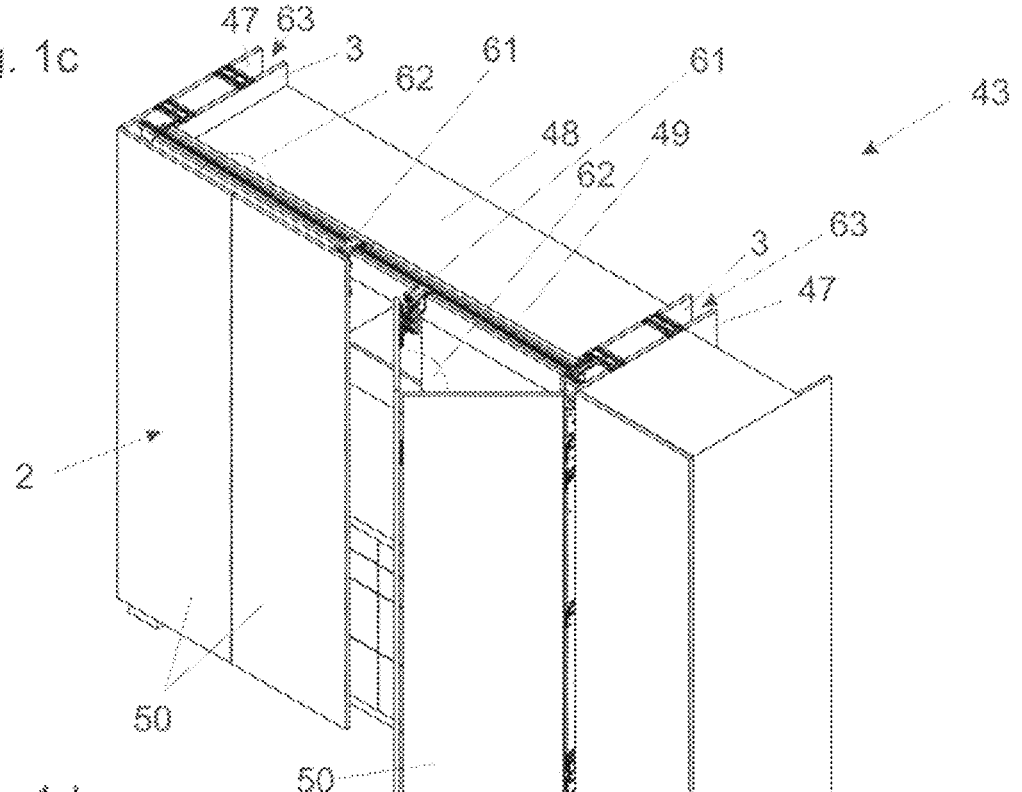
Figure 1D:
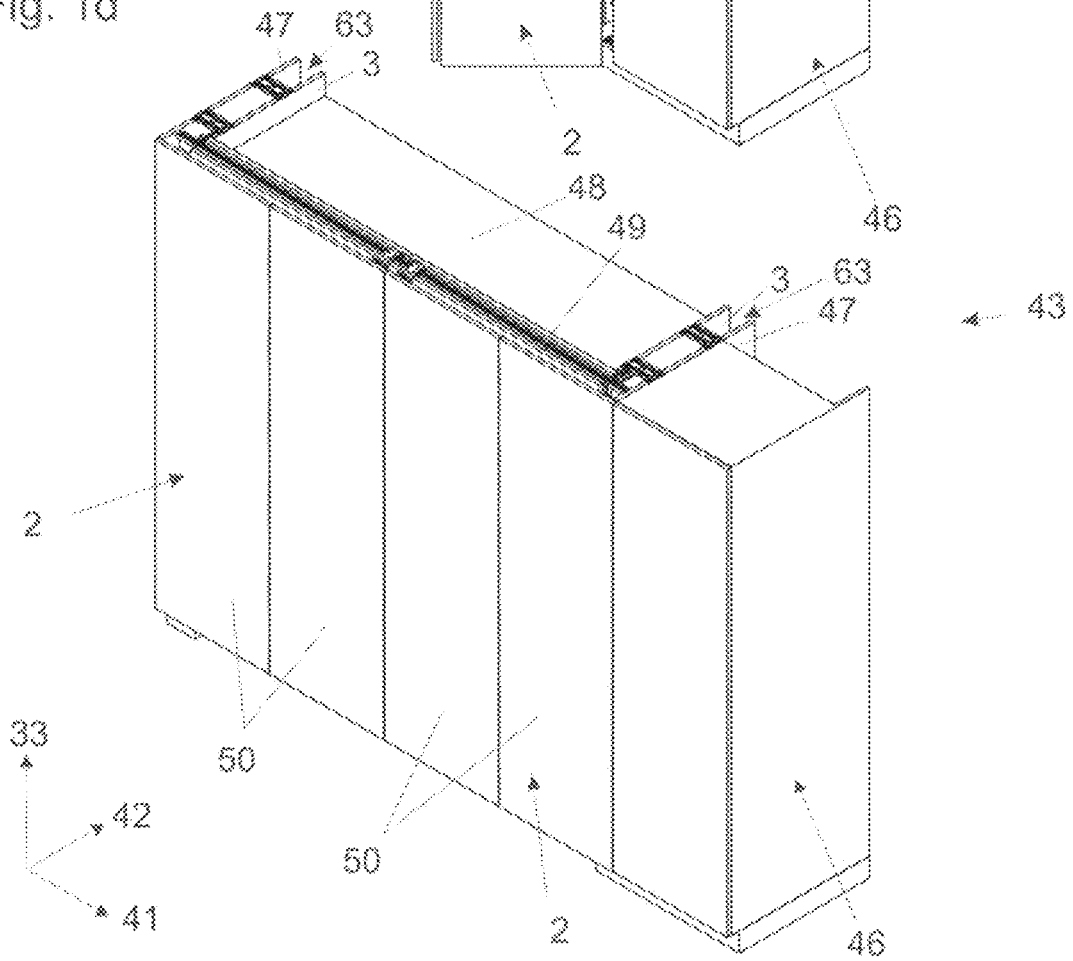

For covering a partial section of the kitchen 43, namely in the depicted case of the base cabinets 44 and the upper cabinets 45, the folding-sliding doors 2 can now be moved out from the compartments 63 (compare FIGS. 1*b* through 1*d*).

Each of the folding-sliding doors 2 are composed of two door wings 50 which, in the positions according to FIGS. 1*a* and 1*b*, are folded together. Starting from this folded together position, the folding-sliding doors 2 can be moved into a spreaded-apart position in which the partial flaps 50 enclose an angle 62 being greater than 0°. In FIG. 1*c*, the right folding-sliding door 2 adopts a position in which the door wings 50 enclose an angle 62 of approximately 90° to one another. The left folding-sliding door 2 adopts a position in which the angle 62 between the door wings 50 is approximately 180°.

In order to transfer the folding-sliding doors 2 from the folded-together position according to FIG. 1*b* into the spreaded-apart positions, a running carriage 61 is arranged on one of each door wing 50, the running carriage 61 being configured so as to be displaceable along the rail 49.

In the configuration according to FIG. 1*d*, the two folding-sliding doors 2 are fully spreaded apart, so that the base cabinets 44 and the upper cabinets 45 are fully covered towards the exterior by the folding-sliding doors 2.

In FIGS. 1*a*-1*d* and in the subsequent figures, the vertical direction is denoted with the reference number 33, the extension in a direction of the width of the kitchen 43 is denoted with the reference number 41, and the extension in a direction of the depth of the kitchen 43 is provided with the reference number 42.

FIGS. 2*a*-2*d* show different preferred embodiments of the arrangement 1 according to the invention for guiding a sliding door or folding-sliding door 2 on a furniture wall 3. The arrangement 1 can thus also be utilized to move a folding-sliding door 2 along the furniture wall 3 or also along the furniture wall 47 into and out from the compartments 63 which are provided with a furniture arrangement according to FIGS. 1*a*-1*d*.

All four embodiments have in common that they include a first guide system 4 to be fixed to the furniture wall 3, and a second guide system 6 to be fixed with a vertical spacing 5 from the first guide system 4. Each of the two guide systems 4, 6 has a guide 7, 8 and guide body 9, 10 displaceably supported on the guide 7, 8. Each of the arrangements 1 further include a carrier 11 on which the sliding door or folding-sliding door 2—indicated by a dotted line—is to be fixed, and the carrier 11 is motionally coupled to the two guide bodies 9, 10 of the guide systems 4, 6. Each of these embodiments further includes a cable pulling device for compensating for a tilting moment 12 of the carrier 11 or of a sliding door or folding-sliding door 2, respectively, about a tilting axis 13 by a return moment 14. The tilting axis 13 is horizontally aligned upon a vertical alignment of the carrier 11 or of the sliding door or folding-sliding door 2, respectively. The cable pulling device ensures that the sliding door or folding-sliding door 2 is guided in a stable manner in each position without tilting, or, when guided on two guide systems 4, 6 substantially aligned in a parallel relationship, will be inclined.

Figure 2A:
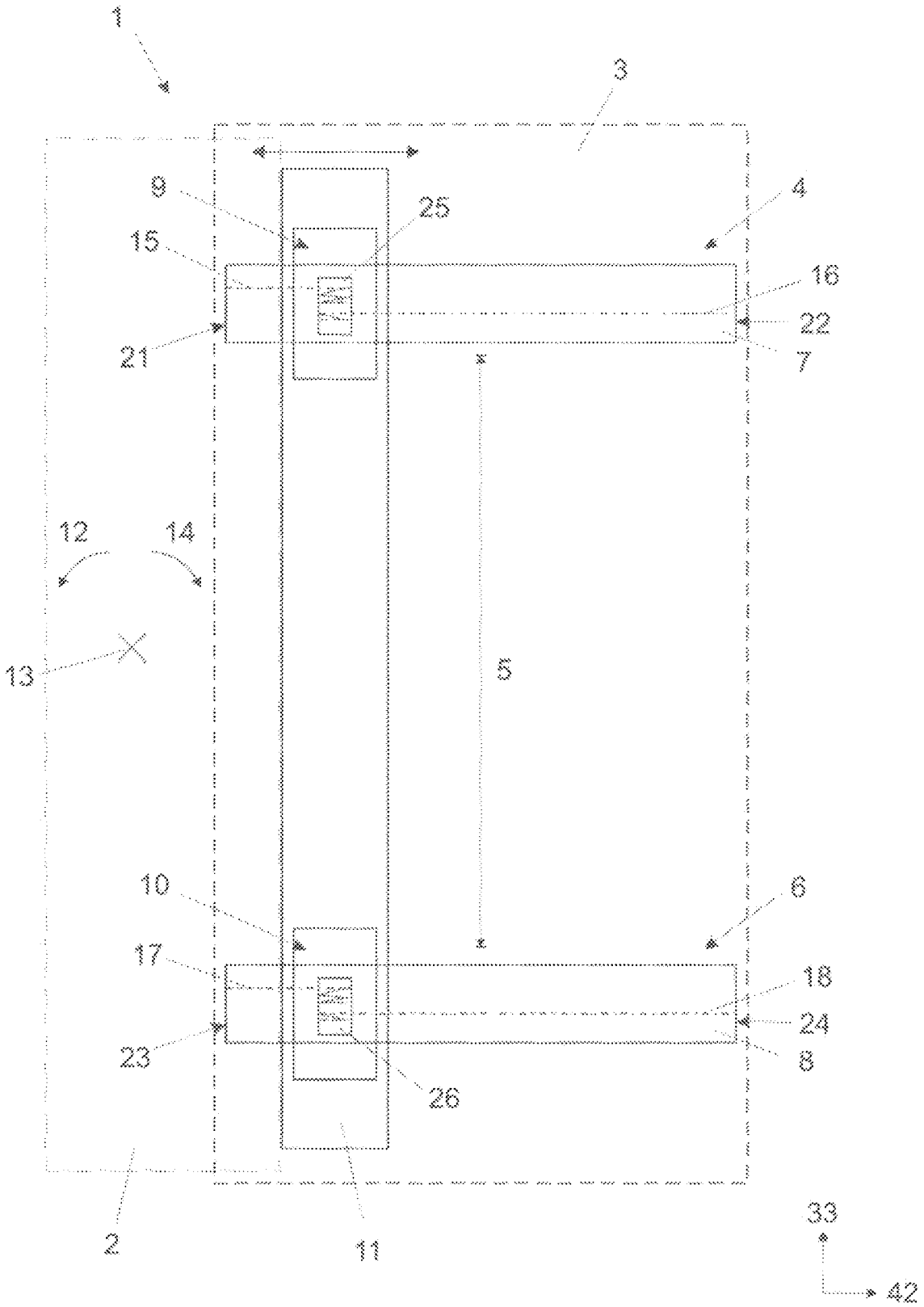
FIGS. 2*a*-2*d* show different embodiments of the arrangement according to the invention for guiding a sliding door or folding-sliding door, each in a schematic view from the side.

With the embodiment according to FIG. 2*a*, the cable pulling device includes four pulling cables 15, 16, 17 and 18. The pulling cable 15 is arranged between the guide body 9 of the first guide system 4 and the end 21 of the guide 7 of the first guide system 4. The pulling cable 16 is arranged between the guide body 9 of the first guide system 4 and the end 22 of the guide 7 of the first guide system 4, and the end 22 opposes the end 21. In an analogous manner, the pulling cable 17 is arranged between the guide body 10 of the second guide system 6 and the end 23 of the guide 8 of the second guide system 6, and the pulling cable 18 is arranged between the guide body 10 of the second guide system 6 and the end 24 of the guide 8 of the second guide system 6.

Each of the guide bodies 9, 10 includes an engagement element 25, 26 for the pulling cables 15, 16, 17, 18, and the engagement element 25, 26 is configured as a storage device in which the pulling cables 15, 16, 17, 18 can be at least partially stored. More specifically, the engagement element 25, 26 can thereby be configured as a rotatably supported winding device (i.e., spool). In the position according to FIG. 2*a*, each of the pulling cables 15, 16, 17, 18 are partially wound up on the winding device, and the windings are schematically indicated by serrated lines. When now the carrier 11 moves to the left, the pulling cables 15 and 17 are even more wound onto the winding device 25 and 26, and the pulling cables 16 and 18 are simultaneously unwound from the winding devices 25 and 26. When the carrier 11 is located on the ends 21 and 23 of the guides 7 and 8, the pulling cables 15 and 17 are thus almost entirely wound up, and the pulling cables 16 and 18 are almost entirely unwound. When the carrier 11 moves to the right, the pulling cables 15 and 17 are unwound and the pulling cables 16 and 18 are simultaneously wound up.

Due to winding and unwinding of the pulling cables 15, 16, 17, 18 upon a displacement of the carrier 11 along the guides 7 and 8, the winding devices and the engagement element 25, 26, respectively, are set in rotation about a rotational axis. This rotational axis can be either arranged about a vertical axis or about a horizontal axis, depending on the support of the engagement element 25, 26 on the guide bodies 9, 10.

The engagement element 25, 26 are not necessarily storage or winding devices. It is only essential that the pulling cables 15, 16, 17, 18, in each position of the guide bodies 9, 10 relative to the guides 7 and 8, are held in a tightened manner between the ends 21, 22, 23, 24 of the guides 7, 8 and the guide bodies 9, 10. In this way, the pulling cables 15, 16, 17, 18 can exert a force between the ends 21, 22, 23, 24 and the guide bodies 9, 10 and, as a result, provide a return moment 14 for compensating for the tilting moment 12.

Each of the pulling cables 15, 16, 17, 18 are, on the one hand, fixed to one of the ends 21, 22, 23, 24 of the guides 7, 8, and, on the other hand, fixed with their opposing ends to the engagement element 25, 26. The fixing needs not directly be effected on the ends 21, 22, 23 and 24 of the guides 7, 8, but rather in a region of these ends. The fixing can be either effected directly on the guides 7 or 8, or else in the region of the ends 21, 22, 23, 24 on the furniture wall 3.

Figure 2B:
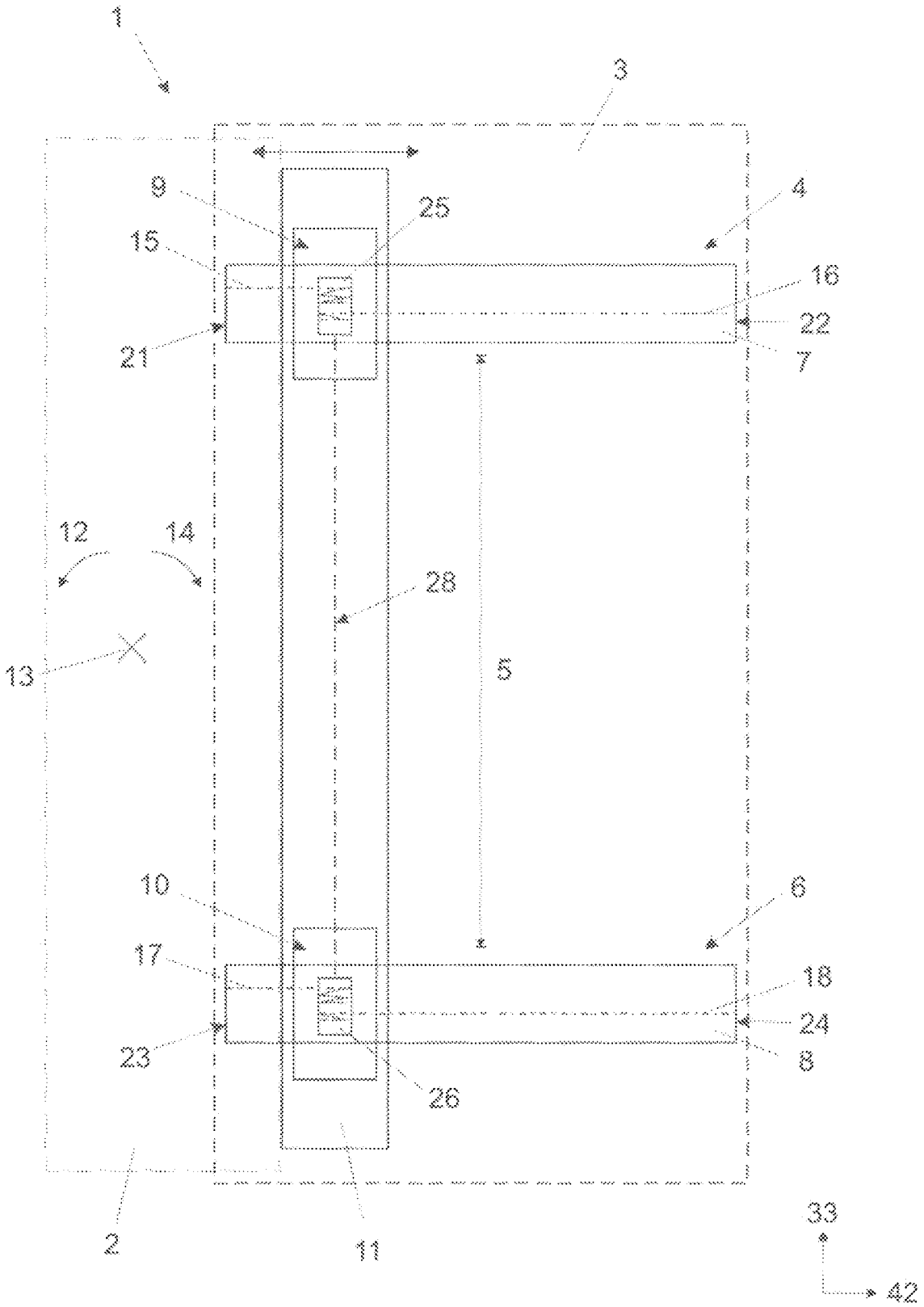

The embodiment according to FIG. 2*b* differs from the embodiment according to FIG. 2*a* by the fact that the engagement element 25, 26 of the guide bodies 9, 10 are coupled to one another by a synchronization device 28. The synchronization device 28 is configured to transmit a torque between the engagement element 25, 26. Accordingly, the winding movements of the winding devices 25, 26 are synchronized with one another. The synchronization is not mandatorily required. However, it further improves the stability of the guidance of the carrier 11 and the stability of a sliding door or folding-sliding door 2 arranged thereon.

Figure 2C:
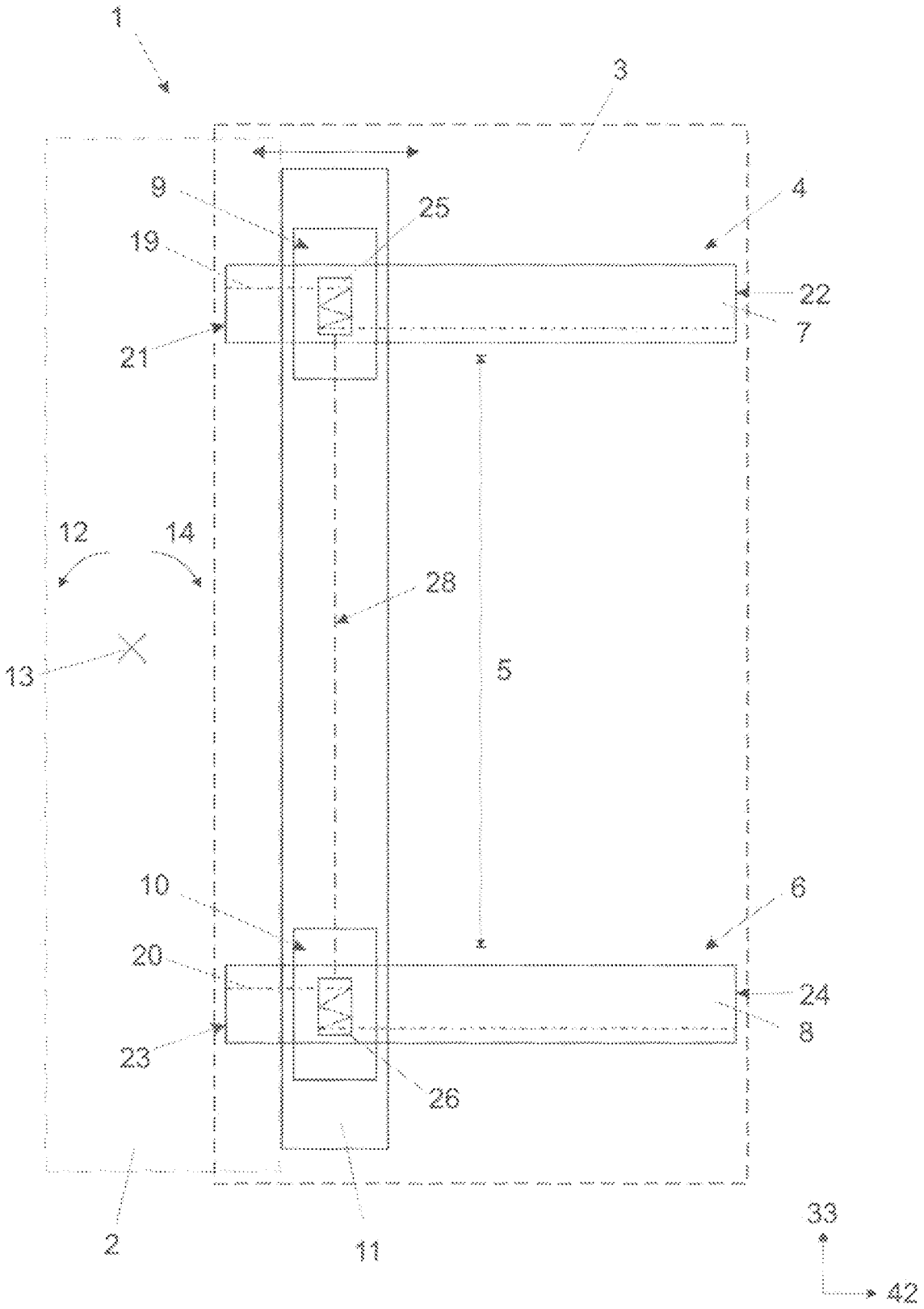

With the embodiment according to FIG. 2*c*, it is provided that the cable pulling device has precisely two pulling cables 19 and 20. The pulling cable 19 is arranged between the guide body 9 of the first guide system 4 and both ends 21, 22 of the guide 7 of the first guide system 4. The pulling cable 20 is arranged, in an analogous manner, between the guide body 10 of the second guide system 6 and the two ends 23, 24 of the guide 8 of the second guide system 6. This means that the pulling cables 19, 20 are not firmly connected with one of their ends to the engagement element 25, 26, but rather rest against with at least one, preferably with a plurality of, winding(s) on the engagement element 25, 26 by friction contact. Each of the ends of the pulling cables 19, 20 are fixed to the ends 21, 22 and 23, 24, respectively, of the guides 7, 8. Upon a movement of the carrier 11 along the guide systems 4 and 6, the pulling cables 19, 20 are simultaneously winded and unwound by the same amount, so that the number of windings remains substantially unaltered.

With the embodiment according to FIG. 2*c*, a synchronization device 28 is depicted. However, the synchronization device 28 can be omitted, in a same manner as in connection with the embodiment according to FIG. 2*a*.

Figure 2D:
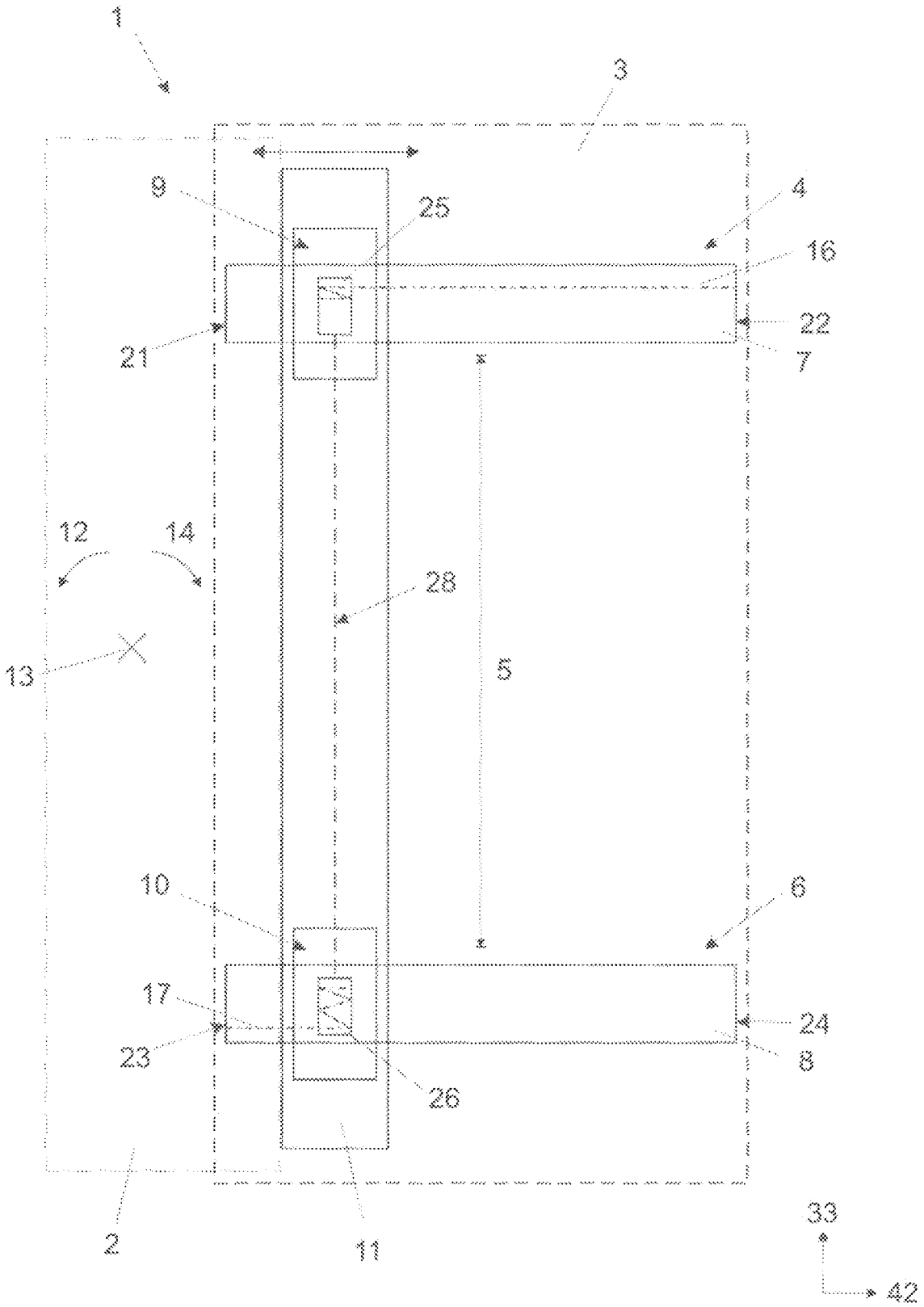

With the embodiment according to FIG. 2*d*, the cable pulling device also includes precisely two pulling cables 16 and 17. The pulling cable 16 is fixed with an end to the end 22 of the guide 7 of the first guide system 4, and with the other end to the engagement element 25. The pulling cable 17 is fixed with one end to the end 23 of the guide 8 of the second guide system 6, and with the other end to the engagement element 26 of the guide body 10. Thereby, the ends 22 and 23 lie diametrically opposite to one another. This means that the ends are not arranged in the same vertical plane, but rather can be connected to one another by a diagonal in a notional rectangle, the rectangle being formed by the ends 21, 22, 23, 24 of the guides 7 and 8.

With the embodiment shown in FIG. 2*d*, a synchronization device 28 is also provided. However, the synchronization device 28 can also be omitted, in a same manner as in connection with the embodiment according to FIG. 2*a*.

The embodiment according to FIG. 2*d* represents a minimal version. When mounting the carrier 11 on the guide bodies 9, 10 or when coupling the guide bodies 9, 10 by means of a synchronization device 28, it is to be noted that the guide bodies 9, 10 are moved in a position in which the pulling cables 16, 17 are in a tensioned condition. This situation is already fulfilled with the other embodiments.

With all four embodiments shown in FIGS. 2*a*-2*d*, the cable pulling device thus includes at least two pulling cables 15, 16, 17, 18, 19 and 20 separated from one another, and one of these pulling cables 15, 16, 17, 18, 19 and 20 is arranged between the guide body 9 of the first guide system 4 and at least one end 21, 22 of the guide 7 of the first guide system 4, and is configured without connection to the second guide system 6. A second of these two pulling cables 15, 16, 17, 18, 19, 20 is arranged between the guide body 10 of the second guide system 6 and at least one end 23, 24 of the guide 8 of the second guide system 6, and is configured without connection to the first guide system 4.

In FIGS. 3-8*d*, a further preferred embodiment of the inventive arrangement 1 for guiding a sliding door or folding-sliding door 2 on a furniture wall 3 is shown. In this embodiment, the cable pulling device is in principle configured in an identical manner as in the embodiment according to FIG. 2*b*.

Figure 3:
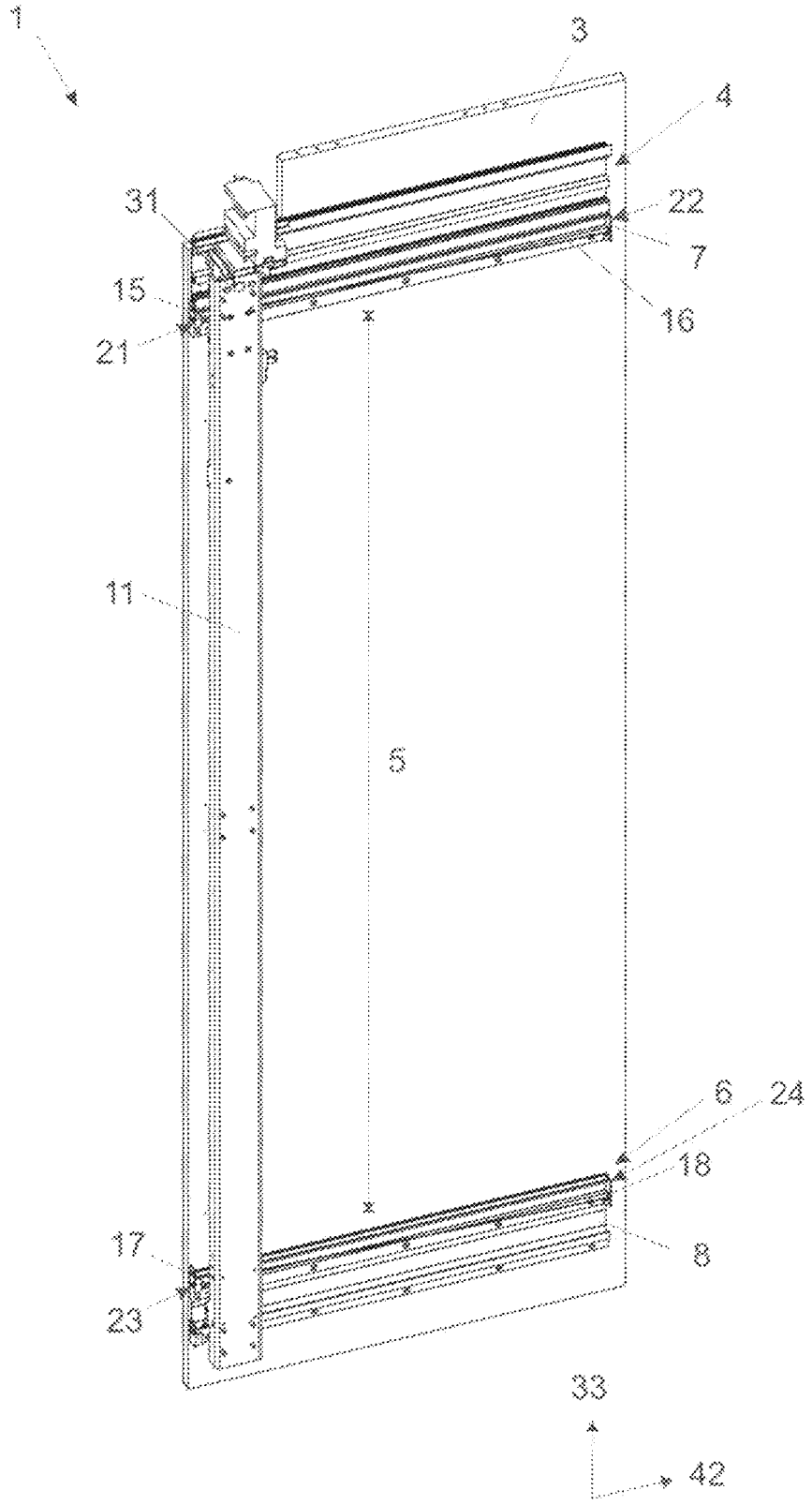
FIG. 3 is a perspective view of a further preferred embodiment of the arrangement according to the invention.

In FIG. 3, the carrier 11 and the guide bodies 9, 10 motionally coupled therewith, respectively, are located in a position adjacent to the ends 21 and 23 of the guides 7 and 8.

Figure 4:
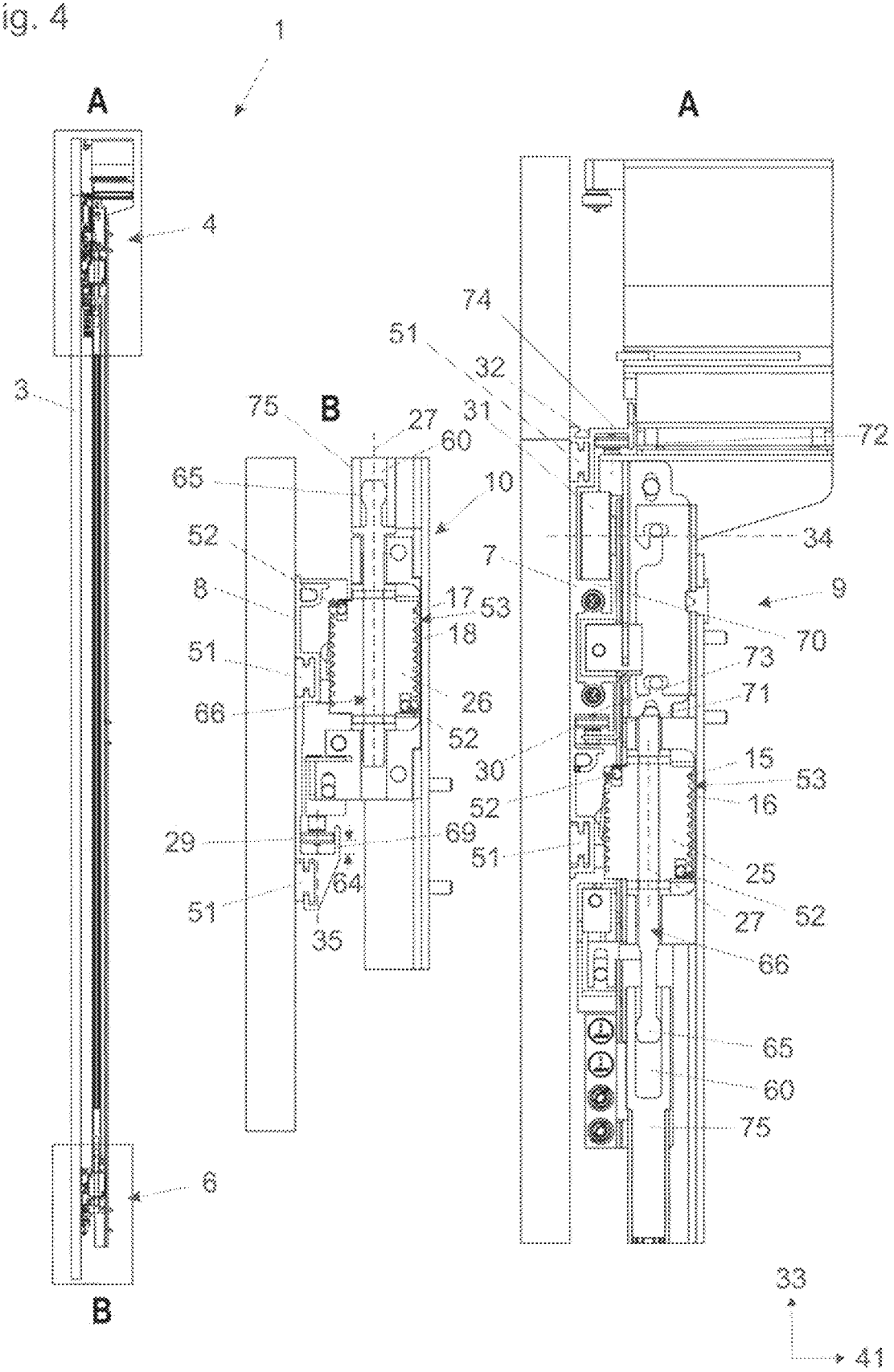
FIG. 4 is a cross-sectional view of the arrangement according to FIG. 3, FIGS. 5*a*, 5*b* show two different positions of the guide bodies of the guide systems of the arrangement according to FIG. 3 (without the carrier), together with a synchronization rod arranged therebetween.

FIG. 4 shows a cross-sectional view in a region of the carrier 11, and the regions of the upper guide system 4 and the lower guide system 6 are depicted in enlarged partial views A and B.

The guides 7, 8 of the guide systems 4, 6 are fixed to the furniture wall 3 by means of pre-mounted profiles 51, onto which the guides 7, 8 are pushed. The profiles 51 are mounted to the furniture wall 3 with a vertical distance 33 from one another.

Supporting profiles 69, 70, 71, 72 are formed on the guides 7, 8, and the guide bodies 9, 10 can be supported on the supporting profiles 69, 70, 71, 72 by rolling bodies 29, 30, 31, 32. Thereby, the upper guide system 4 includes at least one rolling body 31 rotationally mounted about a horizontal axis 34. The rolling body 31 bears the entire weight of the carrier 11 and, respectively, of the sliding door or sliding-folding door 2 arranged thereon. In addition to the at least one rolling body 31 rotationally mounted about a horizontal axis 34, the guide body 9 further includes two rolling bodies 30, 32. Each of the rolling bodies 30, 32 are rotationally supported about a vertical axis 73, 74, and the guide body 9 is laterally guided by the rolling bodies 30, 32.

In comparison thereto, the guide body 10 of the lower guide system 6 only includes rolling bodies 29 which are rotationally supported about a vertical axis 35. These rolling bodies 29 serve for laterally guiding the guide body 10. The guide body 10 is therefore not supported in the vertical direction 33. Instead, the rolling body 29 or the rolling bodies 29 has or have a clearance 64 in the vertical direction 33 in relation to the guide 8, and the clearance 64 compensates for slight inaccuracies when mounting the guides 7, 8. By the clearance 64, it is ensured that the arrangement with the guide bodies 9, 10 and the carrier 11 connected therewith does not get jammed between the guides 7, 8.

In or on each guide body 9, 10, a winding device 25, 26 is arranged, the winding device 25, 26 being configured so as to be pivotable about a vertical axis 27. The winding devices 25, 26 include a spiral-shaped or a helically-shaped groove 53 in which the pulling cables 15, 16, 17, 18 can be accommodated. Each of an end of these pulling cables 15, 16, 17, 18 is firmly connected to the winding device 25, 26. The fastening locations are provided with the reference number 52.

The winding devices 25, 26 are supported in a torque-proof manner on spindles 66, and the spindles 66 protrude in the vertical direction 33 from the winding devices 25, 26. The spindles 66 serve for supporting the winding devices 25, 26 on the one hand. On the other hand, a square member device 65 is formed on the upper end of the spindle 66 of the lower winding device 26 and on the lower end of the spindle 66 of the upper winding device 25. The square member devices 65 can be introduced in corresponding openings 60 arranged on the ends of the synchronization rod 75, whereby a torque can be transmitted between the engagement element 25, 26 of the guide bodies 9, 10.

Figure 5A:
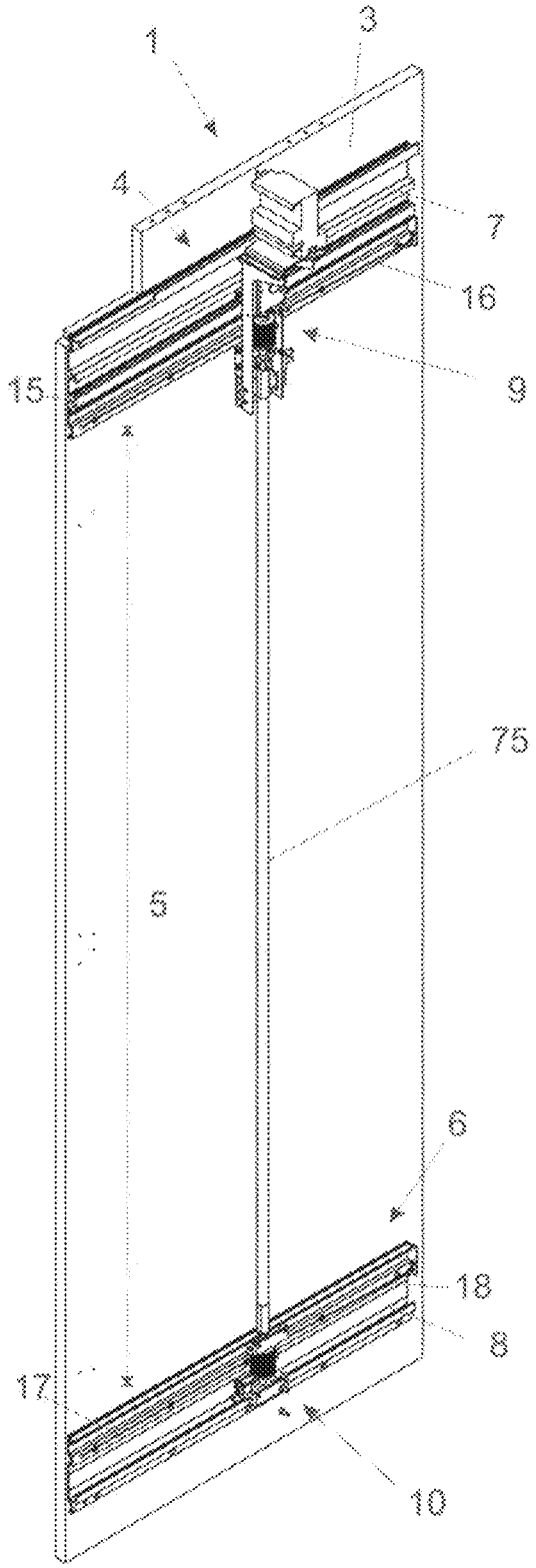
Figure 5B:
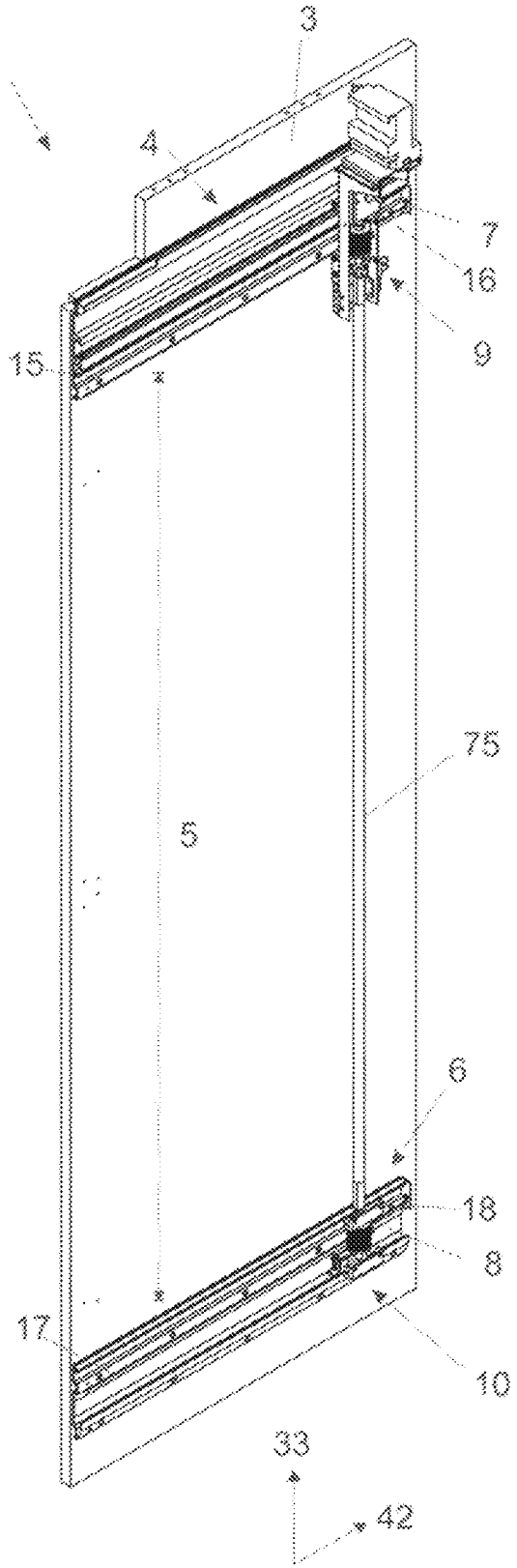

FIGS. 5*a*, 5*b* show a position of the guide bodies 9, 10, together with the synchronization rod 75 arranged therebetween. In comparison to the position according to FIG. 3, a displacement along the guides 7, 8 in a direction of the ends 22, 24 has been performed. FIG. 5*a* shows an intermediate position and FIG. 5*b* shows a position in the region of the ends 22, 24 of the guides 7, 8. In comparison to the illustration according to FIG. 3, the carrier 11 has been omitted.

Figure 6A:
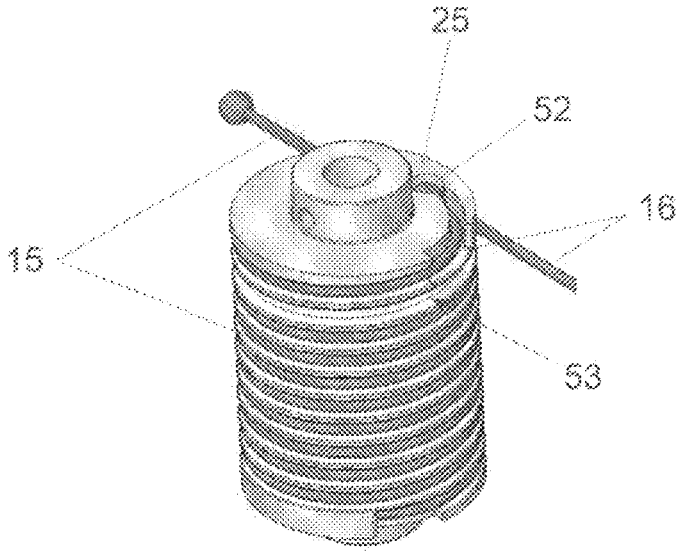
FIGS. 6*a*, 6*b* show a winding device, which, according to a preferred embodiment, is arranged in the guide body of the guide systems, more specifically in different rotational positions.
Figure 6B:
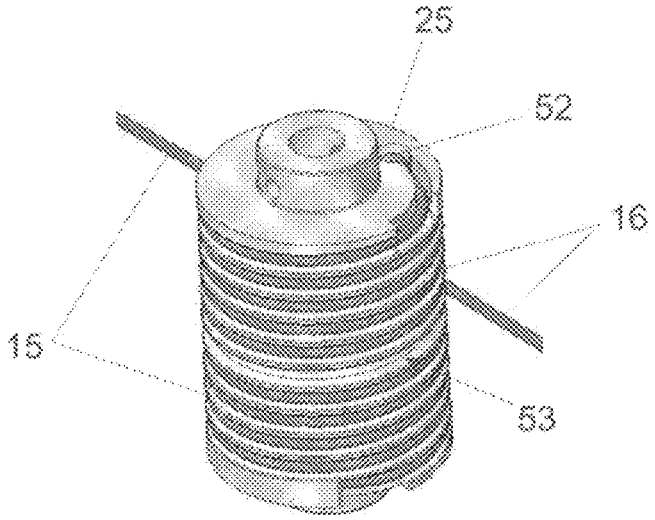

FIGS. 6*a*, 6*b* show an enlarged view of the winding device 25. The position according to FIG. 6*a* corresponds to the condition of the winding device 25 when the guide body 9 adopts a position according to FIG. 3. Each of an end of the pulling cables 15, 16 is fixed to the winding device 25, and the fastening location 52 of the pulling cable 16 is visible. The pulling cable 16 is wound up on the winding device 25 with approximately one winding. The pulling cable 15 is wound up or stored in the winding device 25 with approximately nine windings. Between the storage places for the pulling cable 15 and the pulling cable 16, approximately one free winding is arranged.

FIG. 6*b* corresponds to a position of the winding device 25 when the guide body 9 adopts a position according to FIG. 5*a*. In this condition, the pulling cables 16, 16 are stored in the groove 53 approximately to a same extent.

The condition, which would adopt the winding device 25 in a position of the guide body 9 according to FIG. 5*b*, corresponds substantially to the position according to FIG. 6*a*, in which, however, approximately nine windings of the pulling cable 16 and approximately one winding of the pulling cable 15 were wound up.

The conditions of the pulling cables 17, 18 and the winding device 26 represent in an analogous manner to the conditions according to FIG. 6*a*, 6*b*.

Figure 7A:
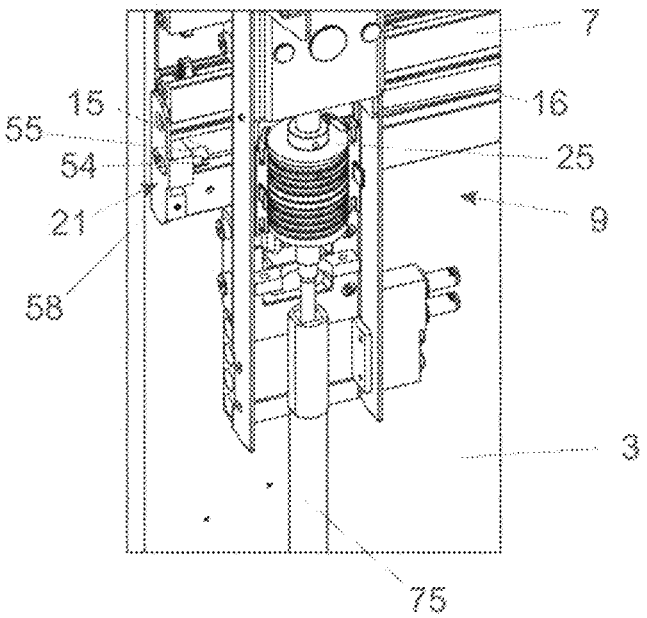
FIGS. 7*a*, 7*b* are partial views of the two ends of the upper guide system.

With the aid of FIG. 7*a*, it is visible how the pulling cable 15 can be fixed to the end of the guide 7. For this purpose, a front plate 58 is arranged on the guide 7, and a cylindrical protrusion 55 with a spherically-shaped recess is arranged on the front plate 58, and the end 54 of the pulling cable 15 can be held in the recess in a form-locking manner.

Figure 7B:
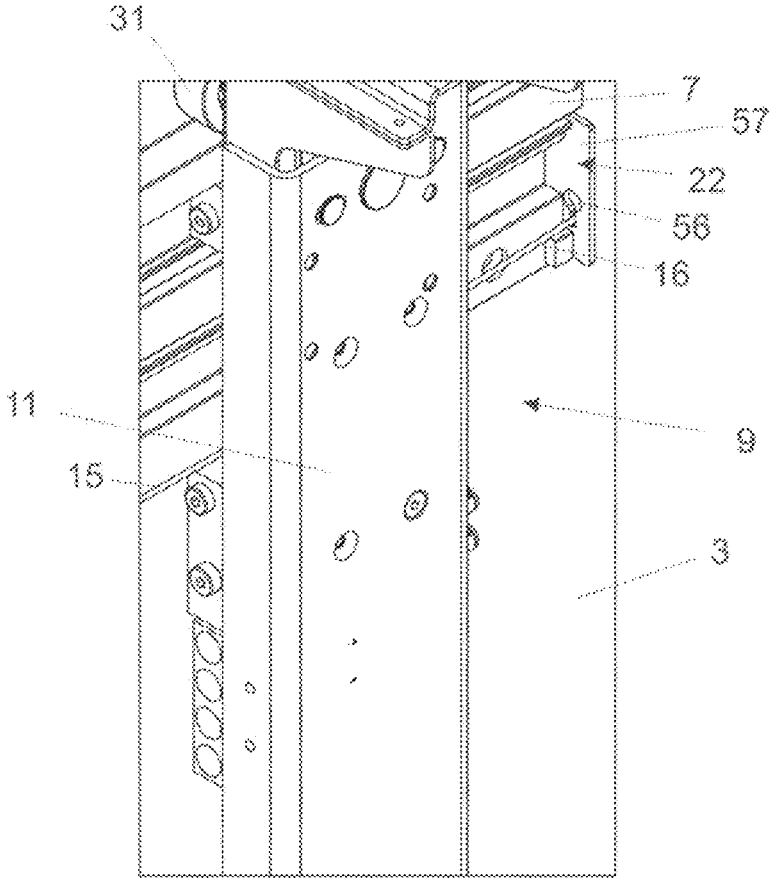

FIG. 7*b* shows a further variant, how a pulling cable—in this case the pulling cable 16—can be fixed to the end 22 of the guide 7. In this case, a plate 57 is connected to the guide 7 or to the furniture wall 3. An opening 56 is arranged on that plate 57, the opening 56 being configured so as to taper in a downward direction, and the opening 56 also serves for holding the end of the pulling cable 16 in a form-locking manner.

FIGS. 7*a*, 7*b* show two examples how to fix the ends of the pulling cables to the guides. However, there are numerous equivalent solutions for the person skilled in the art for fixing the ends of a pulling cable in a force-locking and/or in a form-locking manner.

The sequence of FIGS. 8*a*-8*d* shows how the two engagement element 25, 26 of the guide bodies 9, 10 can be coupled to one another by a synchronization device 28.

As a first step, a synchronization rod 75 is pushed from below onto the square member device 65 of the upper engagement element 25, and the square member device 65 is thereby arranged in a corresponding recess 60 of the synchronization rod 75 (see FIG.8*a*).

Subsequently, the synchronization rod 75 is further moved upwardly in the vertical direction 33, as long as the synchronization rod 75 hits against a housing 59 in which the winding device 25 is arranged (see FIG. 8*b*).

Figure 8A:
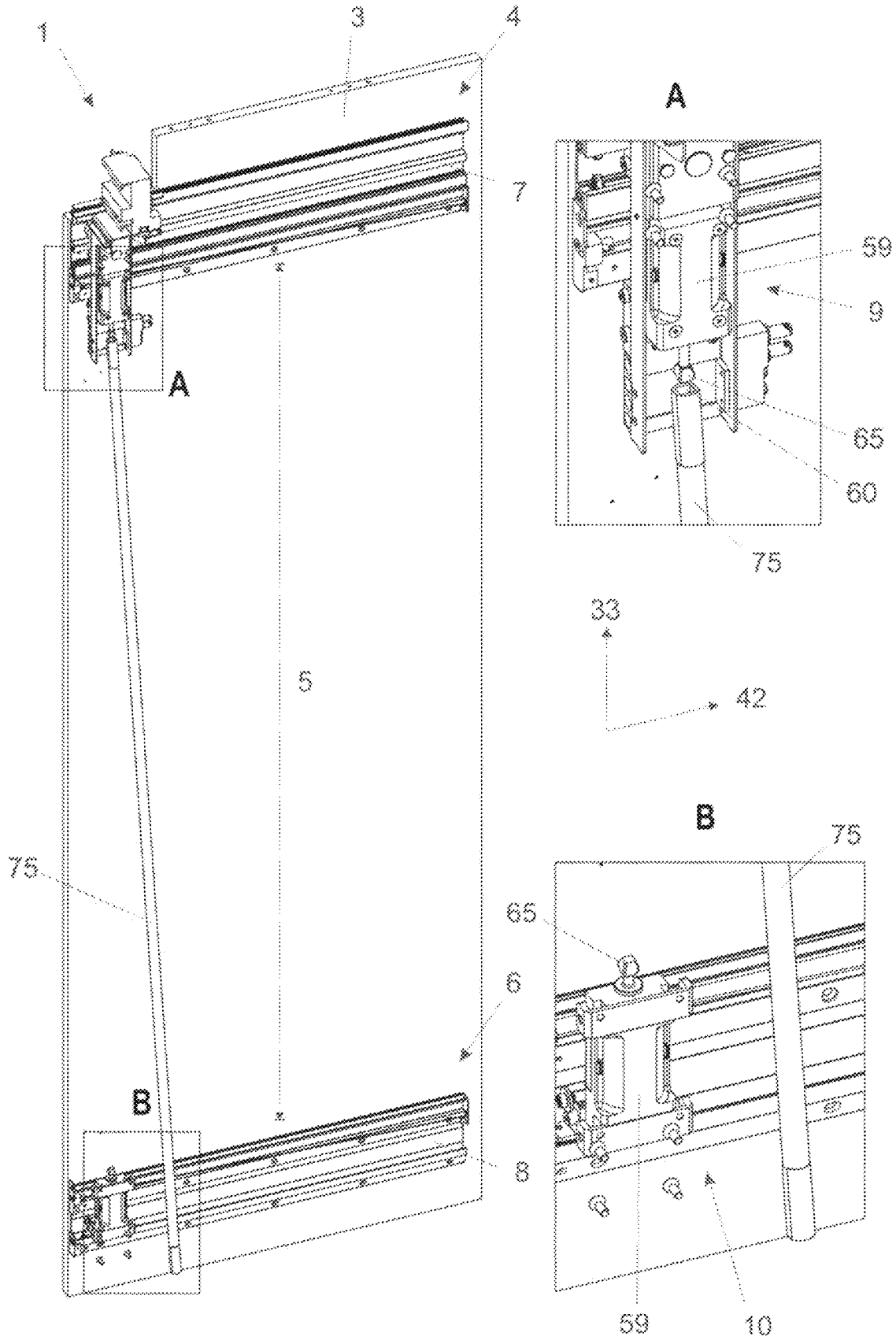
FIGS. 8*a*-8*d* are perspective views of the embodiment according to FIG. 3 without the carrier, in which the sequence of these figures discloses an advantageous mounting of the synchronization rod.
Figure 8B:
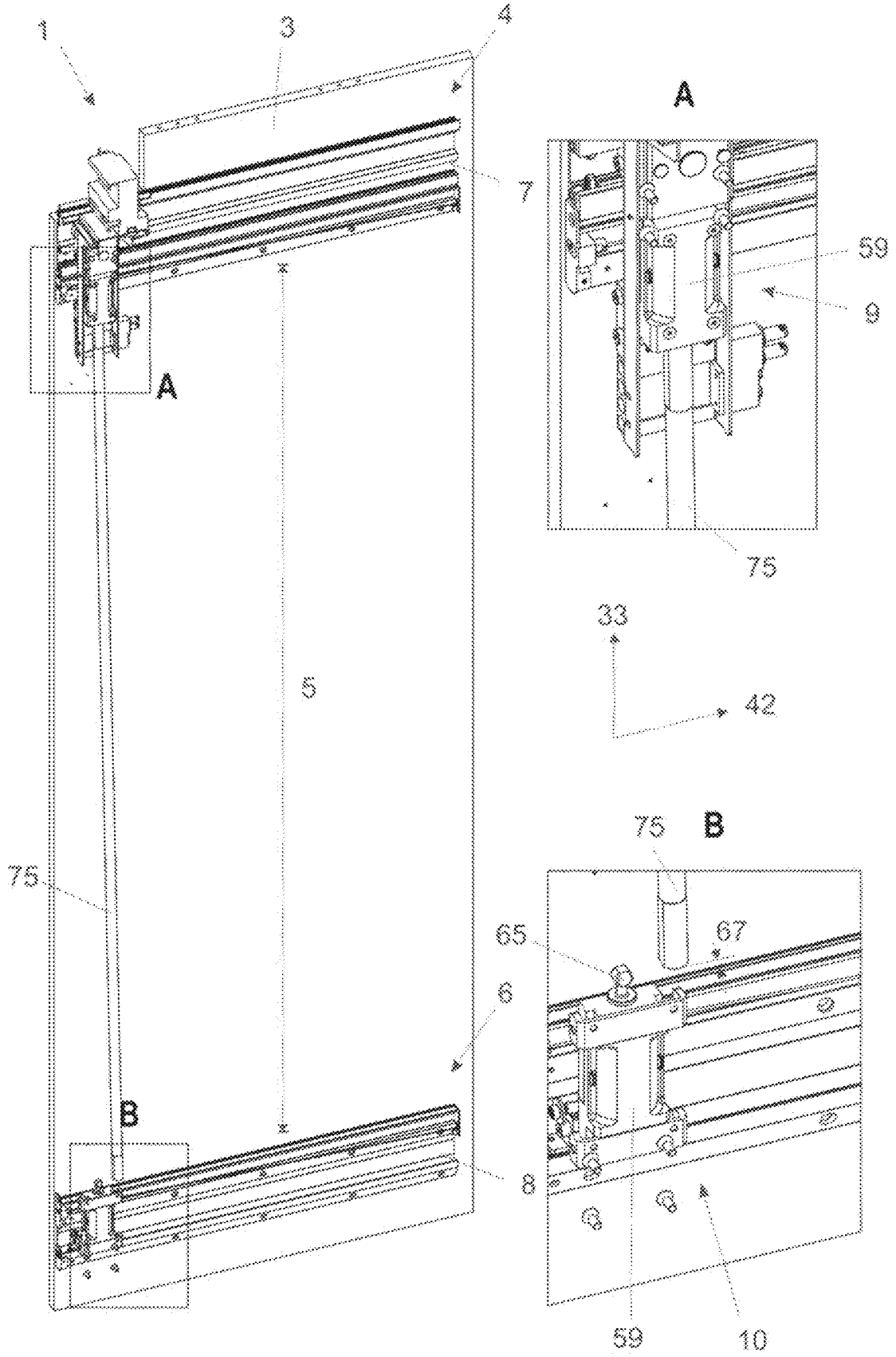
Figure 8C:
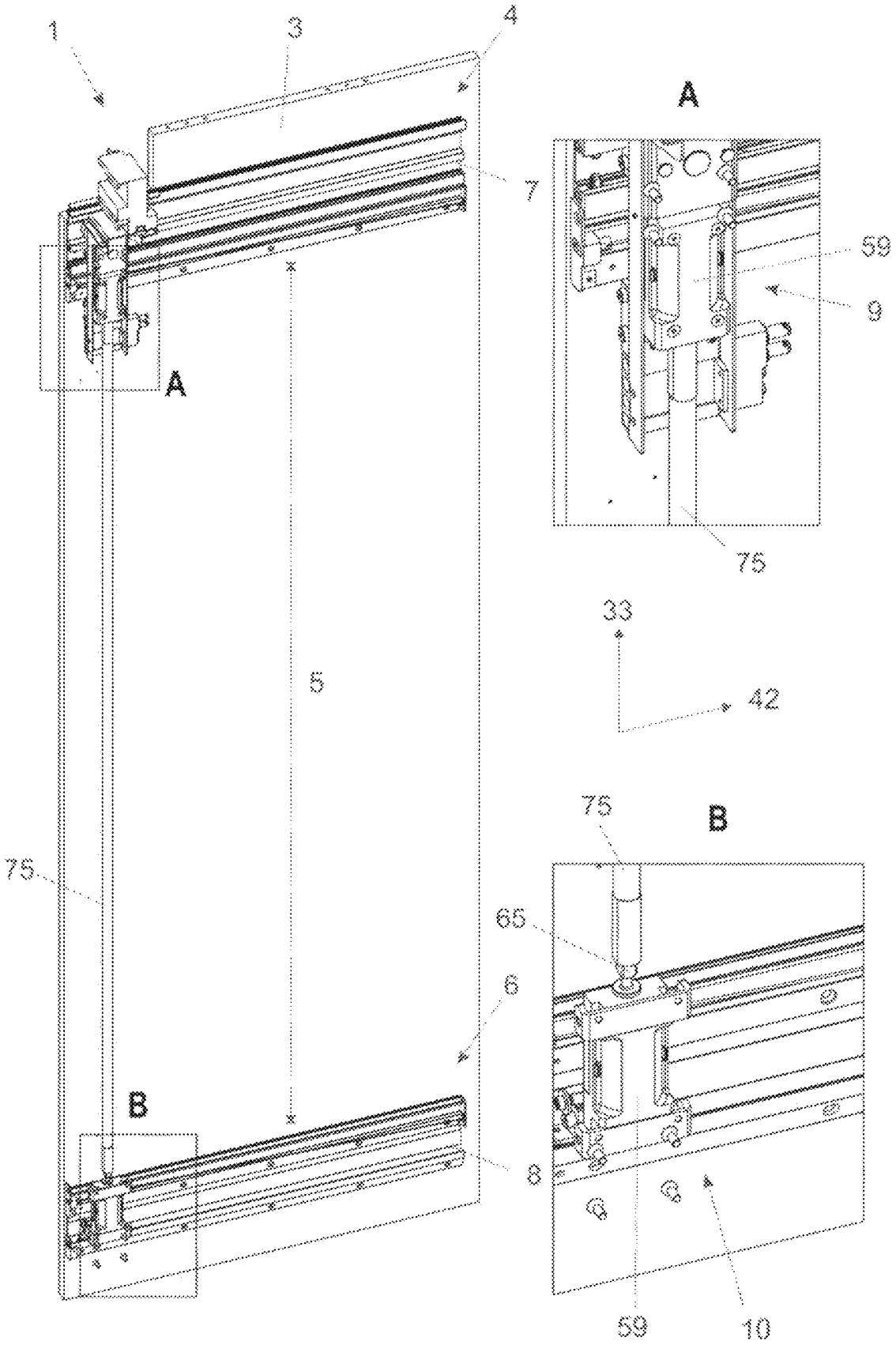
Figure 8D:
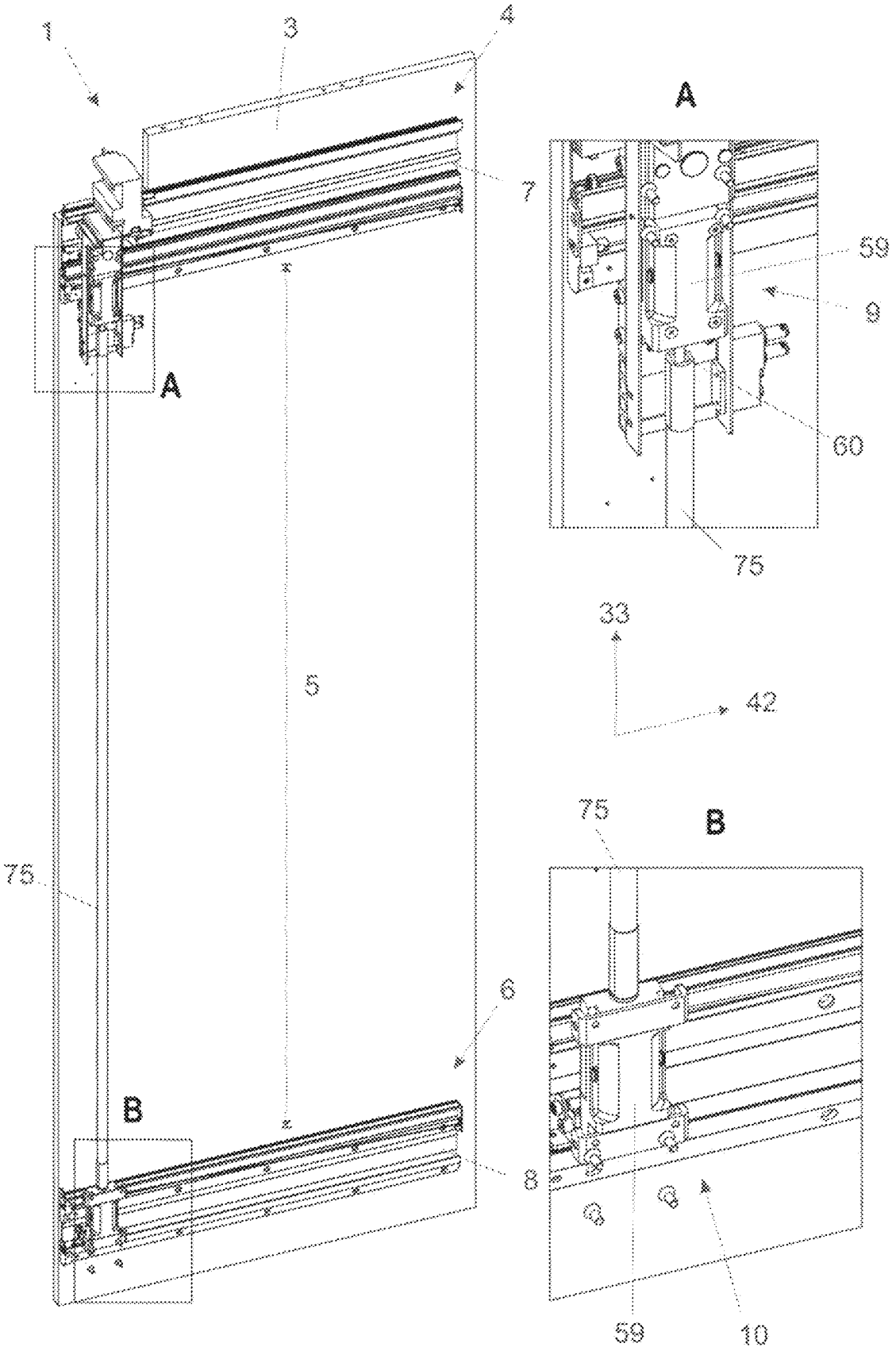

In this way, a vertical clearance 64 of the lower end of the synchronization rod 75 results in relation to the housing 59 of the lower winding device 26, so that the square member device 65 of the lower winding device 26 can be introduced in an opening 60 arranged on the lower end of the synchronization rod 75 (see FIG. 8*c*).

And eventually, one releases the synchronization rod 75. In this way, the synchronization rod 75 glides downwardly under the influence of gravity, until the synchronization rod 75 abuts against the housing 59 of the lower winding device 26 (see FIG. 8*d*). Both square member devices 65 now engage in the corresponding openings 60 in the ends of the synchronization rod 75. In this way, a torque can be transmitted between the engagement element 25, 26 and the guide bodies 9, 10.

It is also possible for the synchronization rod 75 to be mounted exactly opposite in relation to the winding devices 25, 26.

Figure 9:
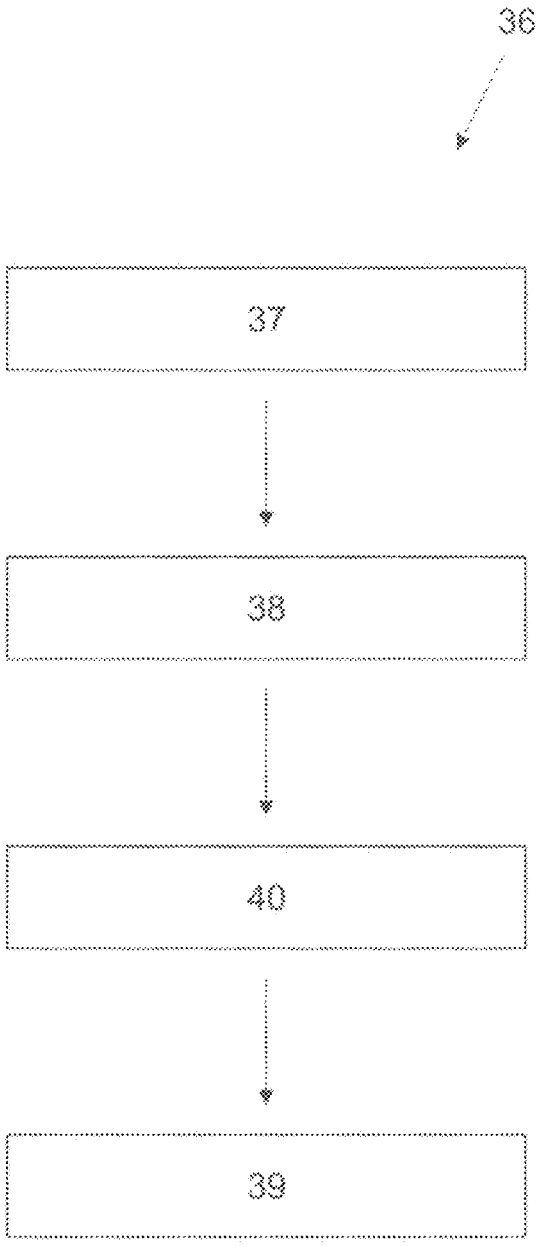
FIG. 9 shows a preferred embodiment of the inventive method for mounting an arrangement according to the invention, schematically depicted with the aid of a process flow diagram.
Figure 10A:
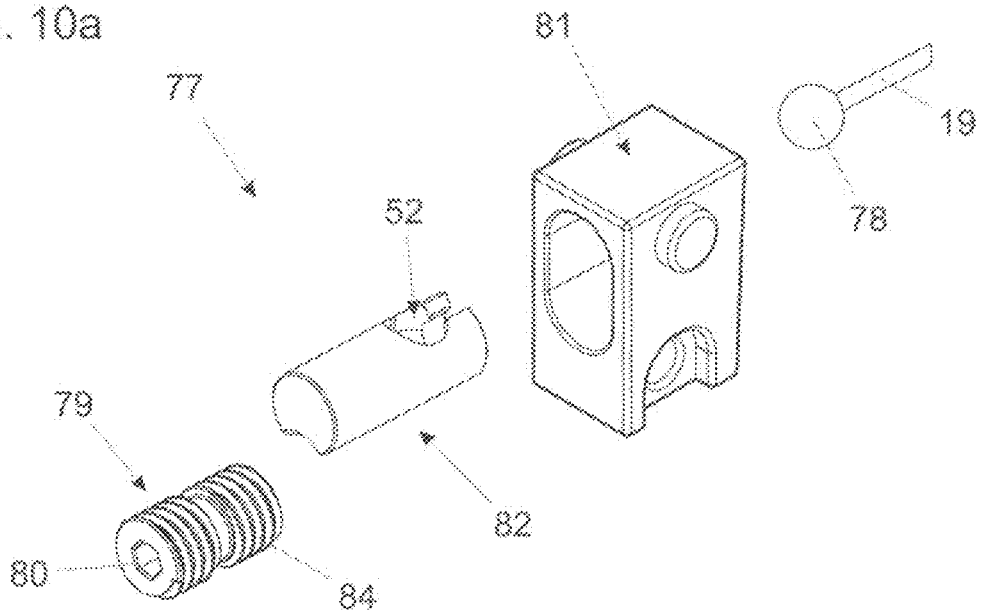
FIGS. 10*a*-10*d* show a device for varying the cable tension in an exploded view (FIG. 10*a*), in a cross-sectional view (FIG. 10*b*) and in two different positions in the mounting condition (FIG. 10*c* and FIG. 10*d*)
Figure 10B:
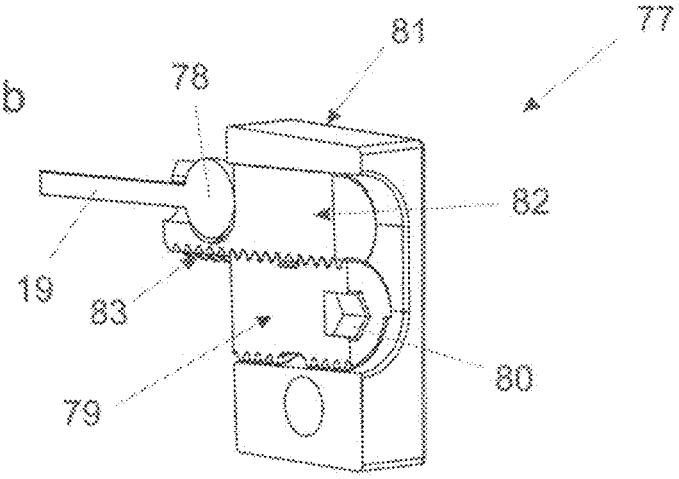
Figure 10C:
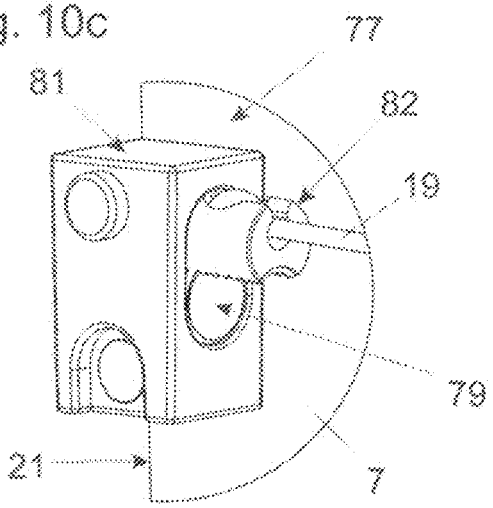
Figure 10D:
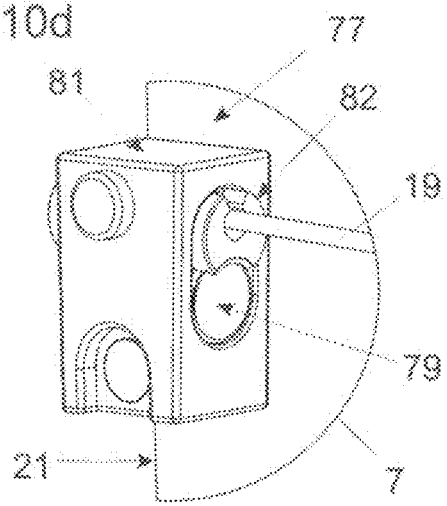

FIG. 9 shows an advantageous embodiment of the method 36 for mounting an inventive arrangement 1 to a furniture wall 3. In a first method step 37, the first guide system 4 or the second guide system 6 is fixed to the furniture wall 3. In a second method step 38, the other guide system 4, 6 is fixed to the furniture wall 3 with a vertical spacing 5 in relation to the guide system 4, 6 which has been fixed to the furniture wall 3 in the first method step 37. In a third method step 39, the carrier 11 is motionally connected to the two guide bodies 9, 10 of the guide systems 4, 6.

If each of the guide bodies 9, 10 includes at least one engagement element 25, 26 for at least one pulling cable 15, 16, 17, 18, 19, 20, it is useful that the engagement element 25, 26 of the guide bodies 9, 10, in a further method step between the second method step 38 and the third method step 39, are coupled to one another by at least one synchronization device 28, as previously described with the aid of FIGS. 8*a*-8*b*.

FIGS. 10*a*-10*d* show a device 77 for varying the tension of the cables by which at least one of the provided pulling cables 15, 16, 17, 18, 19, 20 can be arranged on at least one end 21, 22, 23, 24 of the guide 7, 8 of the first and second guide systems 4, 6. The situation is exemplary shown with reference to the pulling cable 19, the guide 7 and the end 21 of that guide 7.

The device 77 includes a housing 81 in which, on the one hand, a device 82 for holding the pulling cable 19 and, on the other hand, an adjustment element 79 are arranged. The device 82 includes a fastening location 52 in which the end 78 of the pulling cable 19 engages. On a peripheral surface, the device 82 further includes a threaded portion 83 cooperating with a threaded portion 84 formed on the adjustment element 79. The adjustment element 79 includes, on a front face, a key driver 80 for transmitting a torque.

When now the adjustment element 79 is rotated, the device 82 for holding the pulling cable 19 can be adjusted relative to the housing 81. As a result, the tension of the pulling cable 19 can be varied therewith.

The device 77 includes a number of advantages. The pulling cable to be tensioned does not twist upon tensioning. The tensioning device is easily accessible due to its end-sided arrangement. The device 77 further enables an easy and a sensitive adjustment by the transmission ratio caused by the threaded portions. And finally, the device 77 can be easily mounted.

Figure 11:
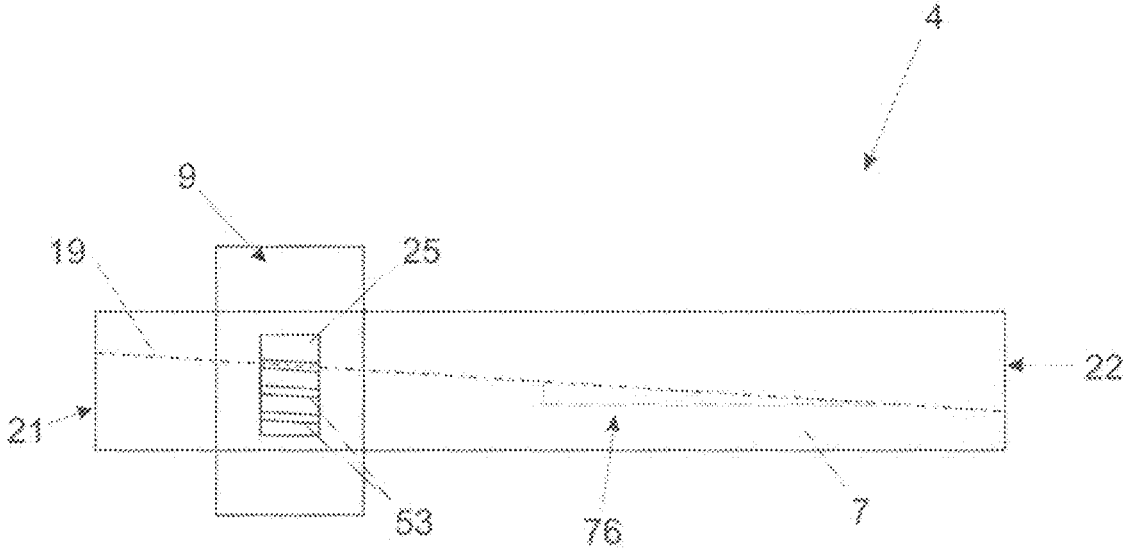
FIG. 11 shows a further embodiment of the arrangement according to the invention for guiding a sliding door or folding-sliding door in a schematic view from the side.

FIG. 11 shows a further embodiment of the inventive arrangement for guiding a sliding door or folding-sliding door 2 in schematic views from the side. In this embodiment, it is provided that the winding device includes a spiral-shaped or a helically-shaped groove 53 in which the associated pulling cable or the associated pulling cables 15, 16, 17, 18, 19, 20 is or can be accommodated. The groove 53 has a pitch, and the pulling cable or the pulling cables 15, 16, 17, 18, 19, 20 is or are arranged on the associated guide system 4, 6 in such a manner that the pulling cable(s) 15, 16, 17, 18, 19, 20 has or have a pitch 76 corresponding substantially to the pitch of the groove 53 of the winding device. Representatively, the situation is shown with reference to the guide system 4 with the guide 7 and pulling cable 19 arranged on both ends.

This embodiment has the advantage that there is no clearance when the pulling cables or winded to and unwound from the winding device.

The invention claimed is:

1. An arrangement for guiding a sliding door or folding-sliding door on a furniture wall, comprising:

a first guide system to be fixed to the furniture wall and a second guide system to be fixed to the furniture wall with a vertical distance from the first guide system, wherein each of the first guide system and the second guide system has a guide and a guide body displaceably arranged on the guide, a carrier to be fixed to the sliding door or folding-sliding door, the carrier being connected in a movement-coupled manner to the guide body of each of the first guide system and the second guide system, and a cable pulling device for compensating for a tilting moment of the carrier or a tilting moment of the sliding door or folding sliding door arranged thereon, respectively, about a tilting axis by a return moment, wherein the cable pulling device includes at least two pulling cables separated from each other, a first one of the at least two pulling cables being arranged between the guide body of the first guide system and at least one end of the guide of the first guide system and being configured without connection to the second guide system, and a second one of the at least two pulling cables being arranged between the guide body of the second guide system and at least one end of the guide of the second guide system and being configured without connection to the first guide system.

2. The arrangement according to claim 1, wherein the at least two pulling cables of the cable pulling device are at least four pulling cables, a first one of the at least four pulling cables being arranged between the guide body of the first guide system and a first end of the guide of the first guide system, a second one of the at least four pulling cables being arranged between the guide body of the first guide system and a second end, opposing the first end, of the guide of the first guide system, a third one of the at least four pulling cables being arranged between the guide body of the second guide system and a first end of the guide of the second guide system, and a fourth one of the at least four pulling cables being arranged between the guide body of the second guide system and a second end, opposing the first end, of the guide of the second guide system.

3. The arrangement according to claim 1, wherein the at least two pulling cables of the cable pulling device are precisely two pulling cables, and the at least one end of the guide of the first guide system, which is connected to the first one of the at least two pulling cables, diametrically opposes the at least one end of the guide of the second guide system, which is connected to the second one of the at least two pulling cables.

4. The arrangement according to claim 1, wherein the first one of the at least two pulling cables is arranged between the guide body of the first guide system and both ends of the guide of the first guide system, and the second one of the at least two pulling cables being arranged between the guide body of the second guide system and both ends of the guide of the second guide system.

5. The arrangement according to claim 1, wherein at least one of the at least two pulling cables is arranged on at least one end of the guide of the first guide system or the second guide system via at least one device for varying the cable tension.

6. The arrangement according to claim 1, wherein the guide body of each of the first guide system and the second guide system includes an engagement element for at least one pulling cable.

7. The arrangement according to claim 6, wherein the engagement element is a storage device configured to at least partially store the pulling cable.

8. The arrangement according to claim 6, wherein the engagement element is a rotationally supported winding device.

9. The arrangement according to claim 8, wherein the winding device is rotationally supported about a vertical axis.

10. The arrangement according to claim 8, wherein the winding device includes a spiral-shaped or a helically-shaped groove configured to accommodate the pulling, the groove having a pitch, and the pulling cable being arranged on the respective one of the first guide system and the second guide system such that the pulling cable has a pitch corresponding to a pitch of the groove of the winding device.

11. The arrangement according to claim 6, wherein the engagement element of the guide body of each of the first guide system and the second guide system is configured to be coupled by a synchronization device.

12. The arrangement according to claim 11, wherein the synchronization device is configured to transmit a torque between the engagement element of the guide body of each of the first guide system and the second guide system.

13. The arrangement according to claim 11, wherein the engagement element of the guide body of each of the first guide system and the second guide system is configured to be releasably coupled by the synchronization device.

14. The arrangement according to claim 1, wherein the guide body of each of the first guide system and the second guide system includes a rolling body for supporting the guide body of each of the first guide system and the second guide system on the guides of the guide systems.

15. The arrangement according to claim 14, wherein the first guide system is configured to be fixed to the furniture wall in a vertical direction above the second guide system, and the rolling body of the guide body of the first guide system being rotationally supported about a horizontal axis.

16. The arrangement according to claim 14, wherein the first guide system is configured to be fixed to the furniture wall in a vertical direction below the second guide system, the guide body of the first guide system having only rolling bodies rotationally supported about a vertical axis.

17. A method of mounting the arrangement according to claim 1 to the furniture wall, the method comprising:

fixing the first guide system to the furniture wall, fixing the second guide system to the furniture wall at a distance from the first guide system fixed to the furniture wall, and motionally coupling the carrier to the respective guide body of each of the first guide system and the second guide system.

18. The method according to claim 17, wherein the guide body of each of the first guide system and the second guide system includes an engagement element for at least one pulling cable, and and the method further comprising coupling the engagement element of the guide body of each of the first guide system and the second guide system to one another by a synchronization device between fixing the second guide system to the furniture wall and motionally coupling the carrier to the respective guide body of each of the first guide system and the second guide system.

* * * * *